United States Patent [19]

Adkins

[11] Patent Number: 4,844,547

[45] Date of Patent: Jul. 4, 1989

[54] SKI LIFT FOOT REST

[76] Inventor: Keith W. Adkins, E. 1644 Nebraska, Spokane, Wash. 99207

[21] Appl. No.: 101,738

[22] Filed: Sep. 28, 1987

[51] Int. Cl.[4] ..... A47C 7/50

[52] U.S. Cl. ..... 297/437; 248/578; 297/423

[58] Field of Search ..... 297/423, 429, 430, 437, 297/438; 403/109; 248/578, 610; 280/163, 164 R, 291; 267/73, 74, 177, 179

[56] References Cited

U.S. PATENT DOCUMENTS

| | | | |
|---|---|---|---|
| 450,907 | 4/1891 | Blakely | 280/291 |
| 602,569 | 4/1898 | Turner | 267/74 |
| 1,392,757 | 10/1921 | Gales | 267/177 X |
| 1,768,905 | 7/1930 | Hartman | 297/437 X |
| 2,321,752 | 6/1943 | Kerr | 297/423 X |
| 3,123,351 | 3/1964 | Graber | 403/109 X |
| 4,013,318 | 3/1977 | Piper | 297/438 |
| 4,032,129 | 6/1977 | Larsson | 267/179 |
| 4,341,400 | 7/1982 | Morgan . | |
| 4,358,138 | 11/1982 | Laughlin et al. . | |
| 4,484,780 | 11/1984 | Thompson | 297/423 X |
| 4,556,252 | 12/1985 | Serex . | |
| 4,582,341 | 4/1986 | Erickson . | |
| 4,589,681 | 5/1986 | Erickson . | |

FOREIGN PATENT DOCUMENTS

| | | | |
|---|---|---|---|
| 439790 | 5/1927 | Fed. Rep. of Germany | 280/291 |

*Primary Examiner*—Peter R. Brown

*Attorney, Agent, or Firm*—Dellett, Smith-Hill & Bedell

[57] ABSTRACT

A ski rest is adapted to be affixed to the side of a ski lift to provide an adjustable resting point for supporting a skier's skies, ski boots, and legs while riding the ski lift so as to relieve the discomfort normally associated with supporting such weight on the back of the skier's legs against the forward edge of the ski lift chair. The ski rest includes a slidable foot rest and biasing means for carrying the weight of the skier's skis, ski boots, and legs as the skis are placed upon the foot rest.

9 Claims, 2 Drawing Sheets

SKI LIFT FOOT REST

The present invention relates generally to ski lifts and particularly to a foot and ski rest for ski lifts.

A ski lift transports skiers from the bottom of a ski run to the top of the ski run. Typically, ski lifts are elevated chair-like devices carried on a continuous cable running from the bottom of the ski run to the top. Skiers board a ski lift chair as it passes through a boarding area and disembark as the chair passes through an unloading area at the top. During the ride to the top of the ski run, the skier assumes a sitting positon and is likely to experience leg discomfort due to the extra weight of the ski boots and skis carried by his or her legs. In particular, the back of the skier's legs must bear the bulk of the extra weight against the forward edge of the chair as the skier's legs extend over the forward edge of the chair.

In some cases, a rail may be pivoted into the general area of the skier's feet for the purpose of providing an elevated rest to place the skis upon, thus relieving the pressure against the back of the skier's legs. Such devices are helpful if the rail happens to pivot into a comfortable location for the skier. Unfortunately, such pivotable rail supports are not adjustable in terms of the distance from the forward edge of the chair to the rail or foot rest. For skiers with relatively long legs the rail may be uncomfortably high, while for skiers with short legs the rail may be too low to sufficiently relieve pressure on the back of their legs.

Ski rests have been developed wherein a ski pole is modified to provide a foot rest. In such devices, a support arm is extended radially of the ski pole shaft and rests on the forward edge of the lift chair while the skier places his or her skis on the pole basket or an extensible foot rest near the pole basket. While having the potential for meeting individual needs, these devices compromise the efficiency of the ski pole in that the pole basket must be specially constructed to carry extra weight or the pole must incorporate additional hardware unrelated to the primary function of the ski pole which would optimally require that the pole be as lightweight as possible.

Portable ski rests have been hung from the forward edge of the ski lift chair to provide a foot rest below. These ski rests are unsatisfactory in that the skier is normally required to carry the device while skiing and therefore constitute an inconvenience.

SUMMARY OF THE INVENTION

According to one aspect of the present invention, an elongated housing is affixed to the side of a ski lift and is adapted to axially receive an extension bar, and the bar being slidable within the housing and having a foot rest mounted thereon. Biasing means are employed to urge the extension bar toward an upward position such that the foot rest is immediately below the forward edge of the ski lift when not in use. While riding the ski lift, a skier places his or her skis on the foot rest, thereby opposing the action of the biasing means such that the foot rest assumes an equilibrium position wherein the weight of the skis, ski boots, and skier's legs are carreid by the foot rest and not by the back of the skier's legs against the forward edge of the ski lift.

The ski rest is easily retro-fitted on existing ski lifts.

It is accordingly an object of the present invention to provide a ski rest adapted to serve the needs of a variety of individuals without the necessity of carrying a separate ski rest device or modifying ski equipment to perform the task.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DRAWINGS

DETAILED DESCRIPTION

Figure 1:
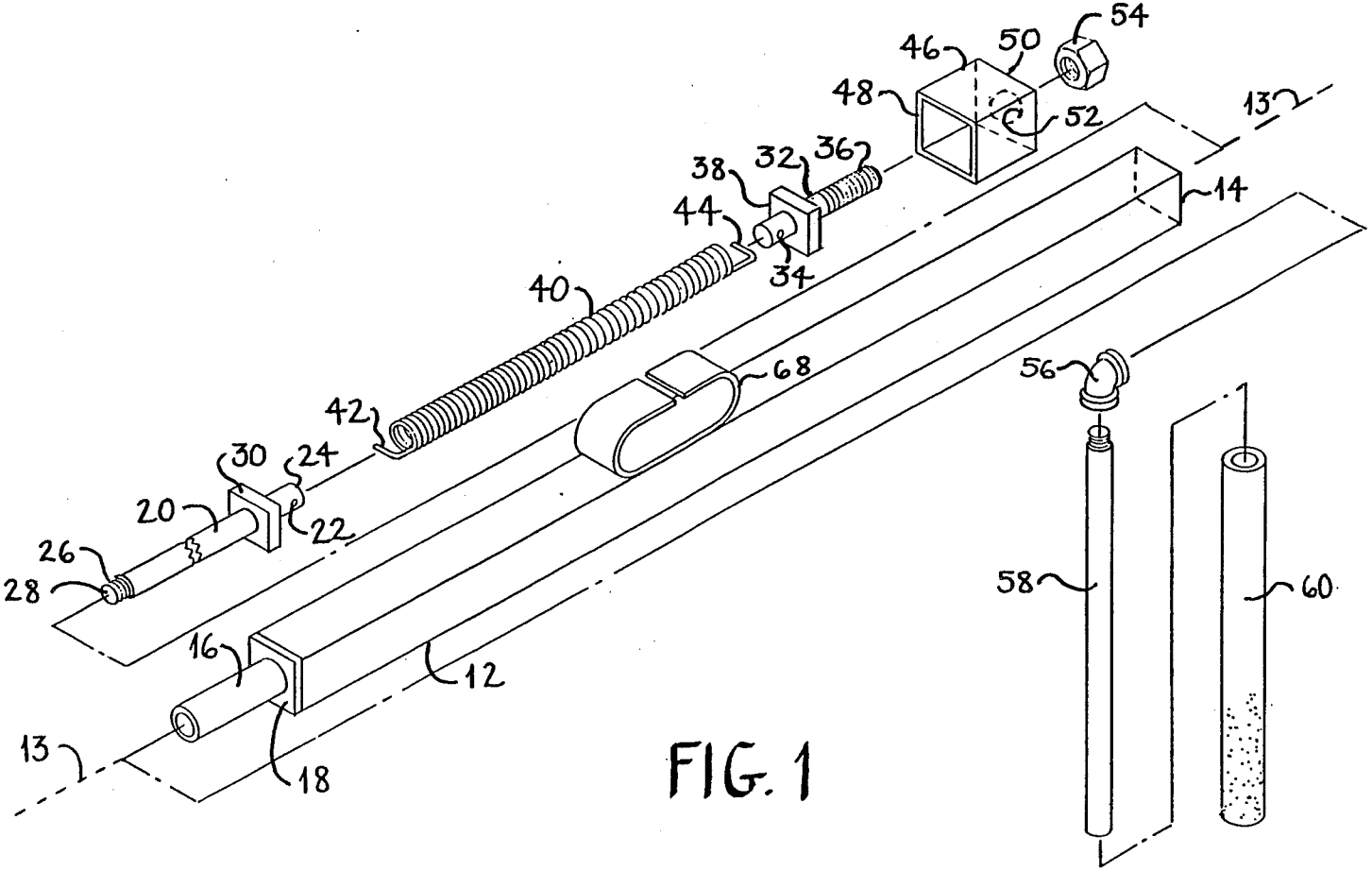
FIG. 1 is an exploded perspective view of a ski rest in accordance with the present invention.
Figure 2:
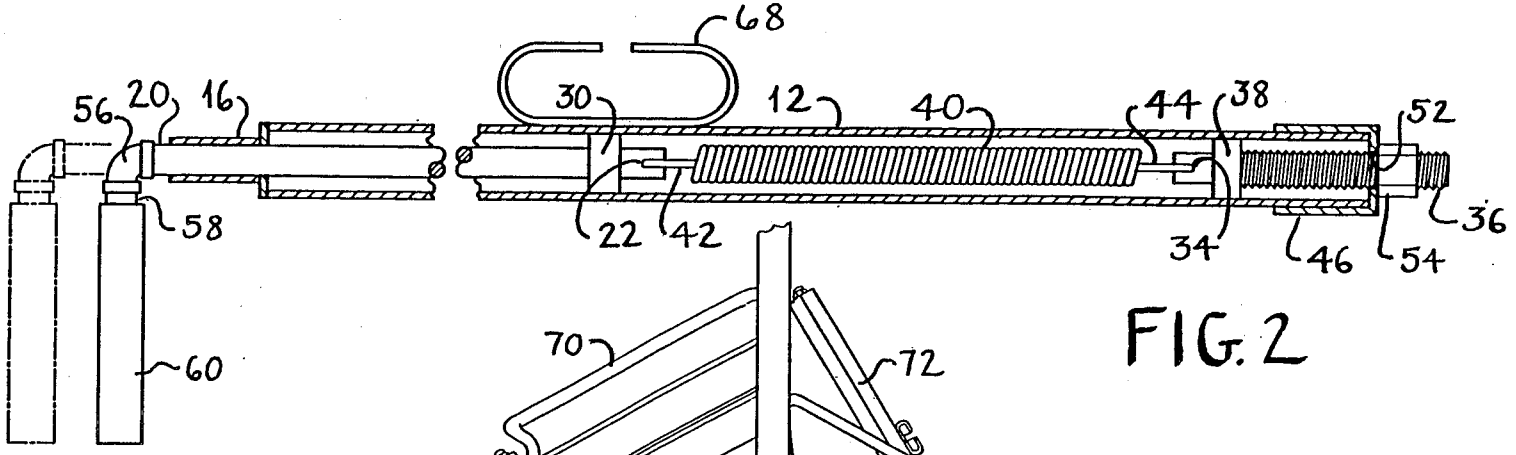
FIG. 2 is a partially cut away, cross sectional view of the ski rest of FIG. 1 in its assembled form.

Referring now to FIGS. 1 and 2, in accordance with the present invention a ski rest comprises a tubular outer housing 12 suitably having a square cross-section, open at a first end 14, and including an end guide 16 affixed at an opposite end 18. The end guide 16 is a tubular member of circular cross-section axially aligned with a central axis 13 of outer housing 12. An extension bar 20 also of circular cross-section and having a lateral hole 22 at a first end 24 and a threaded portion 26 at a second end 28 is dimensioned to be closely received and axially slidable within the end guide 16. A first internal guide member 30 is rigidly affixed to the extension bar 20 near the end 24 between hole 22 and threaded portion 28, the internal guide member 30 having a square cross-section and being diminished to be closely received within the outer housing 12 in axially slidable relation.

An adjustment bar 32, having a lateral hole 34 at a first end and a threaded portion 36 at an opposite end, is provided with a second internal guide member 38 affixed thereon near a first end thereof between hole 34 and threaded portion 36, the internal guide member 38 having a square cross-section and being dimensioned to be closely received within the outer housing 12 in axially slidable relation. A spring 40 having a first hooked end 42 adapted to be received within hole 22 and a second hooked end 44 adapted to be received within hole 34 couples the adjustment bar 32 and the extension bar 20.

A tubular end cap 46, also of square cross-section and dimensioned to be fitted over outer housing 12, has a first open end 48 and a substantially closed second end 50 provided with a hole 52 centrally aligned with the central axis 13 of the outer housing 12 when said cap 46 is positioned upon the end 14 of the outer housing 12 to receive adjustment bar 32. Adjustment nut 54 is threadable upon portion 36 of adjustment bar 32.

An elbow 56 threadably receives portion 26 of extension bar 20, while a second end of the elbow similarly receives an elongate foot rest 58 taking the form of a straight rod having threads on one end. A tubular rubber ski protector 60 is positioned upon and substantially surrounds the foot rest 58 to form a soft outer skin for the foot rest.

To assemble the ski rest, the hooked end 42 of the spring 40 is inserted in hole 22 of the extension bar 20, while the hooked end 44 of the spring 40 is inserted in the hole 34 of the adjustment bar 32 for coupling the extension bar and the adjustment bar. Threaded portion 36 of adjustment bar 32 is inserted through the hole 52 such that the nut 54 may be threaded thereon. Next, end 28 of the extension bar 20 is inserted in end 14 of the outer housing 12, passed through the length of outer housing 12, and through end guide 16 so as to expose the threaded portion 26 beyond the end guide 16, and cap 46 is positioned over the end 14 of the outer housing 12. The threaded portion 26 of extension bar 20 and the foot rest section 58 are threaded into elbow 56. Ski protector 60 is positioned to surround the foot rest 58.

The extension bar 20 is movable within and along the length of the outer housing 12 as the guides 16 and 30 maintain it in coaxial relation with the central axis 13 of housing 12. Guide 30 also prevents rotation of the extension bar 20 and foot rest 58 with respect to the housing 12. Contraction of the spring 40 urges the extension bar 20 toward end 14 of the outer housing 12 to an "up" position. The combined length of the adjustment bar 32, the spring 40 while contracted, and the extension bar 20 is preferably greater than the combined length of the outer housing 12 and the guide 16, so as to allow the spring 40 to be fully contracted without causing the elbow 56 to contact the guide 16. The axial position of the adjustment bar 32 determines the axial location of the extension bar 20 in its "up" position. Adjustment bar 32 and extension bar 20 are thus axially positionable by rotation of nuts 54. Guide member 38 and hole 52 maintain adjustment bar 32 coaxial of the central axis 13 of the outer housing 12, while the guide member 38 also prevents rotation of the adjustment bar 32 with respect to outer housing 12 as nut 54 is rotated.

A ski pole holder 68 is affixed to the outer housing 12 and may be used by skiers to stow their ski poles while using the ski rest.

Figure 3:
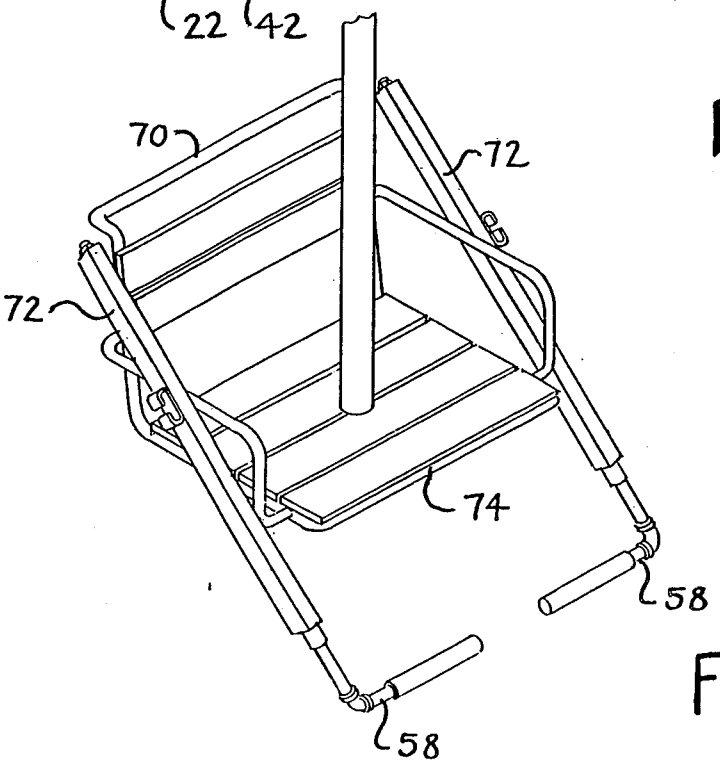
FIG. 3 is a perspective view of a lift chair utilizing a pair of ski rests similar to that of FIG. 1.

FIG. 3 illustrates a two-person ski lift chair 70 utilizing a pair of ski rests 72 according to the present invention affixed to the sides thereof by welds or bolts (not shown). The ski rests 72 are positioned such that while in the "up" position, the foot rests 58 are below the forward edge 74 of the lift chair 70 but above the level at which a skier's skis would be as he sits on the chair lift 70 and allows his or her legs to hang over the edge 74. Skiers riding on the lift chair 70 may place their skis on one of the foot rests 58. The spring 40 extends in response to the weight of the skis, ski boots and the skier's legs and allows bar 20 to move downwardly to an equilibrium position where the additional weight is countered by the force produced by the tension of spring 40. Advantageously, the ski rest serves a variety of skiers, i.e. with long or short legs, in that the ski rest is self-adjusting in terms of the distance from the forward edge 74 of the lift chair 70 to the foot rest 58. Moreover, the ski rest retracts automatically when not in use.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A ski lift foot rest comprising:

an extension bar having a distal end and a proximal end, the proximal end including an aperture;

a foot rest adapted to be coupled to the distal end of said extension bar;

an elongate housing having a first end and a second end, said housing being adapted to slidably support said extension bar;

an adjustment bar having a first end and a second end, the first end having a threaded portion and the second end having an aperture therein;

an adjustment nut threadable upon the first end of said adjustment bar;

a cap mountable upon the first end of said housing and having an aperture dimensioned to receive the threaded end of said adjustment bar; and a spring having a first hooked end and a second hooked end, the first hooked end being insertable within the aperture at the proximal end of said extension bar and the second hooked end being insertable within the aperture at the second end of said adjustment bar, said adjustment bar, adjustment nut, cap, and spring comprising means for biasing the proximal end of said extension bar toward the first end of said housing.

2. A ski lift foot rest in accordance with claim 1, wherein said housing is tubular and of square cross section and said adjustment bar comprises:

a rod, first end of said rod constituting the first end of said adjustment bar and a second end of said rod constituting the second end of said adjustment bar; and a guide member affixed to said rod and having a square cross section, the guide member being adapted to be slidably received within said housing.

3. In combination, a ski lift and a ski lift foot rest, the ski lift comprising a seat having a forward edge, the foot rest comprising:

an extension bar having a distal end and a proximal end;

an elongate foot rest, having a proximal end and a distal end, adapted to be coupled at its proximal end in cantilever fashion to the distal end of said extension bar and in substantially parallel relation to the forward edge of said seat;

an elongate housing having a first end and a second end, said housing being affixed rigidly by fastening means to said ski lift and adapted to slidably support said extension bar; and means biasing the proximal end of said extension bar toward the first end of said housing for relieving pressure experienced by a person sitting on the seat with legs hanging over the forward edge and feet resting on said foot rest.

4. A ski lift foot rest in accordance with claim 3, wherein said foot rest is elongate and extends radially from said extension bar, and said ski lift foot rest includes means for preventing rotation of said extension bar about a longitudinal axis of said extension bar.

5. A ski lift foot rest in accordance with claim 3, wherein said housing is tubular and dimensioned to receive said extension bar therewithin.

6. A ski lift foot rest in accordance with claim 3, wherein said housing is tubular and of square cross section and said extension bar comprises:

a rod, a first end of said rod constituting the proximal end of said extension bar and a second end of said rod constituting the distal end of said extension bar; and a guide member affixed to said rod, said guide member being of square cross section and dimensioned to be closely received within said housing and slidably supported therein.

7. A ski lift foot rest in accordance with claim 3, wherein said biasing means is a spring coupling the proximal end of said extension bar and the first end of said housing.

8. In combination, a ski lift and a ski lift foot rest, the ski lift having a seat comprising a forward edge, the foot rest comprising:

an extension bar having a distal end and a proximal end;

a foot rest adapted to be coupled to the distal end of said extension bar;

an elongate housing having a first end and a second end, said housing being affixed to said ski lift and adapted to slidably support said extension bar;

an adjustment bar having a first end and a second end, the first end having a threaded portion and the second end having an aperture therein;

an adjustment nut threadable upon the first end of said adjustment bar;

a cap mountable upon the first end of said housing and having an aperture dimensioned to receive the threaded end of said adjustment bar; and a spring having a first hooked end and a second hooked end, the first hooked end being insertable within the aperture at the proximal end of said extension bar and the second hooked end being insertable within the aperture at the second end of said adjustment bar, said adjustment bar, adjustment nut, cap and spring comprising means biasing the proximal end of said extension bar toward the first end of said housing for relieving pressure experienced by a person sitting on the seat with legs hanging over the forward edge and feet resting on said foot rest.

9. A ski lift foot rest in accordance with claim 8, wherein said housing is tubular and of square cross section and said adjustment bar comprises:

a rod, a first end of said rod constituting the first end of said adjustment bar and a second end of said rod constituting the second end of said adjustment bar; and a guide member affixed to said rod and having a square cross section, the guide member being adapted to be slidably received within said housing.

* * * * *